US006581305B2

(12) United States Patent
Ho

(10) Patent No.: US 6,581,305 B2
(45) Date of Patent: Jun. 24, 2003

(54) FOOTWEAR WITH FIXEDLY SECURED INSOLE FOR STRUCTURAL SUPPORT

(75) Inventor: James Ho, Northridge, CA (US)

(73) Assignee: Odyssey Shoes, Inc., Azusa, CA (US)

( * ) Notice: Subject to any disclaimer, the term of this patent is extended or adjusted under 35 U.S.C. 154(b) by 0 days.

(21) Appl. No.: 09/777,130

(22) Filed: Feb. 5, 2001

(65) Prior Publication Data

US 2001/0032397 A1 Oct. 25, 2001

Related U.S. Application Data

(60) Provisional application No. 60/180,070, filed on Feb. 3, 2000.

(51) Int. Cl.[7] ..... A43B 1/10

(52) U.S. Cl. ..... 36/102; 36/17 R; 36/3 B

(58) Field of Search ..... 36/17 R, 17 A, 36/102, 17 PW, 30 A, 3 B

(56) References Cited

U.S. PATENT DOCUMENTS

| | | | | | |
|---|---|---|---|---|---|
| 2,074,121 | A | * | 3/1937 | Goodyear | 36/17 R |
| 2,354,338 | A | * | 7/1944 | Stritter | 36/17 R |
| 2,429,255 | A | * | 10/1947 | Ashley | 12/142 F |
| 2,546,296 | A | * | 3/1951 | Braun | 36/19.5 |
| 3,125,816 | A | * | 3/1964 | Gartner | 36/117.3 |
| 3,736,613 | A | * | 6/1973 | Tusa et al. | 12/142 D |
| 4,183,156 | A | | 1/1980 | Rudy | |
| 4,580,356 | A | | 4/1986 | David | |
| 4,619,056 | A | | 10/1986 | Lin et al. | |
| 4,879,821 | A | | 11/1989 | Graham et al. | |
| 5,014,706 | A | | 5/1991 | Philipp | |
| 367,164 | A | | 2/1996 | Fisher et al. | |
| 5,611,153 | A | | 3/1997 | Fisher et al. | |
| 5,901,468 | A | | 5/1999 | Whyte | |
| 5,915,820 | A | | 6/1999 | Kraeuter et al. | |
| 5,987,779 | A | | 11/1999 | Litchfield et al. | |

* cited by examiner

*Primary Examiner*—Ted Kavanaugh
(74) *Attorney, Agent, or Firm*—Liu & Liu

(57) ABSTRACT

The present invention is directed to a footwear construction having an insert of unitary structure and made of a single flexible material for providing increased structural support and strength of the footwear while maintaining flexibility of the footwear. Unlike the prior art insert, the present invention makes use of only a single material is used to manufacture the insert. A preferred material should be pliant or flexible and yet can provide the strength and structural support to the footwear in which the insert is used. Instead of using materials of different softness for the various sections in the insert to facilitate bending of the footwear, openings are added to various locations in the insert to facilitate planar bending movement. Such openings are commonly located in the forefoot section. To increase structural support and strength to the footwear, the insert is fixedly secured to the footwear. In accordance with one embodiment of the present invention, the insole construction has a flange, which is stitched to the other layers in the footwear, for example using a welt.

8 Claims, 6 Drawing Sheets

FOOTWEAR WITH FIXEDLY SECURED INSOLE FOR STRUCTURAL SUPPORT

This application claim's benefit of provisional application No. 60/180,070 filed Feb. 3, 2000.

BACKGROUND OF THE INVENTION

1. Field of the Invention

This invention relates to footwear, and more particularly to a footwear to be used in rugged environment, having improved structural support and flexibility.

2. Description of Related Art

One of the main criteria in shoe design is to design a footwear that is sturdy enough to protect the wearer's feet and yet flexible enough to provide for comfortable walking. This is particularly true for rugged footwear such as work boots, where comfort is often compromised in a design for a strong footwear that can withstand tough conditions.

The use of inserts in a footwear is well-known in the prior art. The purpose of many existing inserts, especially insoles, is for increasing comfort for the wearer by ways of providing additional cushioning and/or ventilation qualities. Many of the existing insoles are removable from the footwear for easy disposal or replacement. Since these insoles are removable items, they are generally not intended to provide structural support and strength to the footwear in which such insoles are used.

Indeed, very little prior art suggests the use of insoles as a structural chassis for providing increased structural support and strength of the footwear.

In U.S. Pat. No. 5,915,820, to Kraeuter et. al., a structural chassis made of a stiff, resilient material, such as vinyl or plastic, is disclosed. Further, notches of various length and width are placed in various portions of the chassis to provide a desired degree of stiffness and/or flexibility along the chassis. One of the unique features of the footwear disclosed in the Kraeuter patent is that the footwear does not have contiguous midsole and outsole. Further, the structural chassis is used to provide structure support for a footwear in areas without any outsole or midsole material. In other words, the structural chassis is the primary structural support of the footwear in those areas. The purpose of this combination of the structural chassis with non-contiguous midsole and outsole is to make a footwear that is flexible and light, and yet still provides certain structural support. The primary objective of the, Kraeuter patent is to eliminate the midsole and outsole, which normally span the entire length of the footwear, so that the weight of the footwear can be minimized. This invention is relevant to the design of footwear where light weight is a primary consideration, such as running or sports shoes. The Kraeuter patent discloses that the structural chassis is to be bonded to other layers of materials to form the sole of the footwear. Further, since the primary focus of the invention is to produce a light weight footwear for sports, it is not anticipated that the wearer will wear the footwear in extreme rugged conditions on a regular basis, for example in the case of a work boot, where strength and structural support are a primary concern.

One example of using an insole for providing increased structural support and strength to the footwear used .in rugged conditions, such as a work boot, can be found in a product brochure for Roadmate's 2000 Collection. In the brochure, an insole using Texon material is described. The Texon insole described utilizes the HYTERLINK™ Technology (Hyper Tension Release Link). The Texon insole utilizes a Texon board, which is a paper board. But instead of using the old-fashioned way of cementing (or gluing) a cloth welt around it, the HYTERLINK™ technology utilizes PVC compounds injected into a mold that is in the shape of the insole. The insole is then injected onto the Texon board. On the insole, there is an inner welt, which is also formed by the injected PVC compound. The inner welt is sewn onto the insole, which provides lateral and torsional resistance, thus strengthening the footwear. There are also certain energy transfer bridges, again formed by the injected PVC compound, which serve to transfer shock and vibrations from the center to the side (the welt), onto the outsole and then to the ground.

The presence of the Texon insole provides enhanced lateral rigidity to the footwear, thus providing increased structural support and strength to the footwear. The reinforcement by the welt also strengthens the lateral support. However, as noted above, the Texon insole described is not a unitary structure. It is recognized that an insole construction made entirely of the existing PVC compounds would substantially decrease the flexibility of the footwear. In order to maintain some flexibility at various sections of the insole, especially the forefoot section, PVC material is removed or no PVC compound is injected for those sections. However, the absence of the PVC compound in those sections also decreases the efficacy of using the PVC compound to increase the strength of the footwear. Further, because of the addition of the Texon board, the Texon insole is heavier and not water proof, and tends not to return substantially to its original shape after it is bent. Also, the Texon board is susceptible to structural deterioration due to prolonged flexing. Further, the use of different materials, such as the PVC compounds and the Texon board, to make the Texon insole, also increases the manufacturing costs and decreases the production efficiency.

As indicated, commonly, ways of increasing structural support and strength of the footwear may compromise its flexibility. Thus, the construction of an insole used to provide increased structural support and strength of the footwear must take into account the materials used, their softness and their ability to provide structural support and strength to the footwear.

SUMMARY OF THE INVENTION

The present invention is directed to a sole construction including an insole of a unitary structure and made of a single flexible material for providing increased structural support and strength of the footwear while maintaining certain level of flexibility of the footwear. Unlike the prior art Texon board insole construction, the present invention makes use of only a unitary construction of a flexible material to manufacture the insole. A preferred material should be pliant or flexible but yet can provide the strength and structural support to the footwear in which the insole is used.

Instead of using materials of different softness for the various sections in the insole to facilitate bending of the footwear, openings are added to various locations in the insole to facilitate planar bending movement without significantly compromising the lateral rigidity of the insole. Such openings are commonly located in the forefoot section of the insole.

To increase structural support and strength to the footwear, the insole construction is fixedly secured to the footwear around the perimeter of the insole. In accordance with one embodiment of the present invention, the insole construction is stitched to the other layers in the footwear around the insole, for example using a welt.

Another embodiment of the invention is a footwear, constituting a combination of the insole as described, a midsole, and an outsole. In this embodiment, similar to the insole, the midsole also contains openings but such openings are extended through the entirety of the midsole's surface, Similar to the openings in the insole, the openings in the midsole supplement and increase the flexibility of the footwear.

BRIEF DESCRIPTIONS OF THE DRAWINGS

The present invention will be more clearly understood when considering in conjunction with the accompanying drawings in which.

Figure 6A:
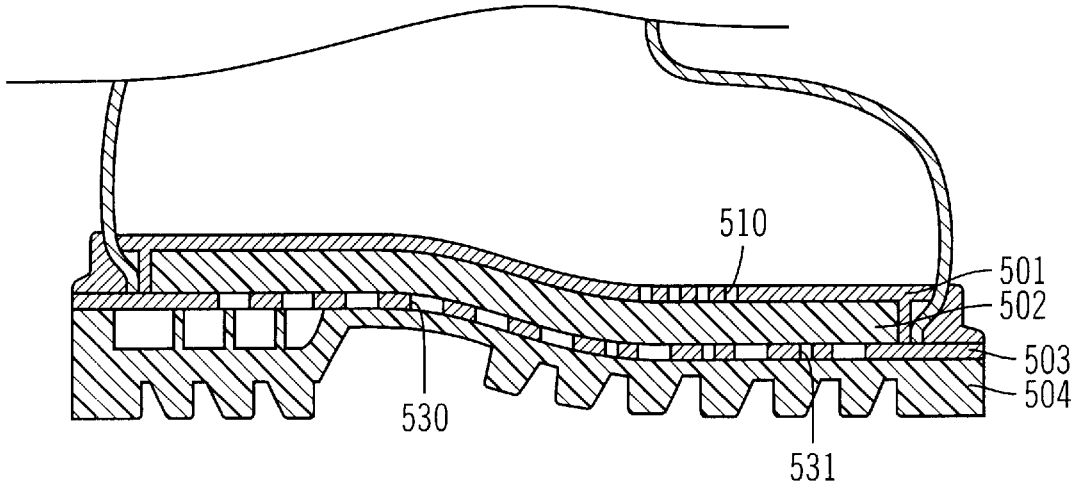

FIG. 6*a* is a side view of a wearer at a resting position wearing a footwear showing a cross-sectional view of the various components of the lower portion of the footwear in accordance with one embodiment of the present invention.

Figure 6B:
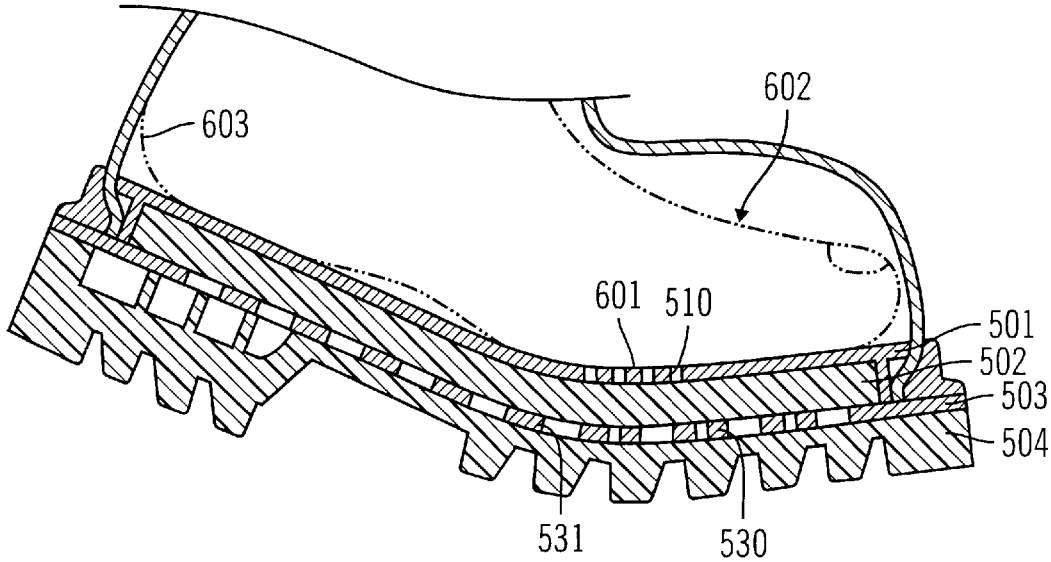

FIG. 6*b* is a side view of a wearer at a walking position wearing a footwear showing a cross-sectional view of the various components of the lower portion of the footwear in accordance with one embodiment of the present invention.

Figure 7:
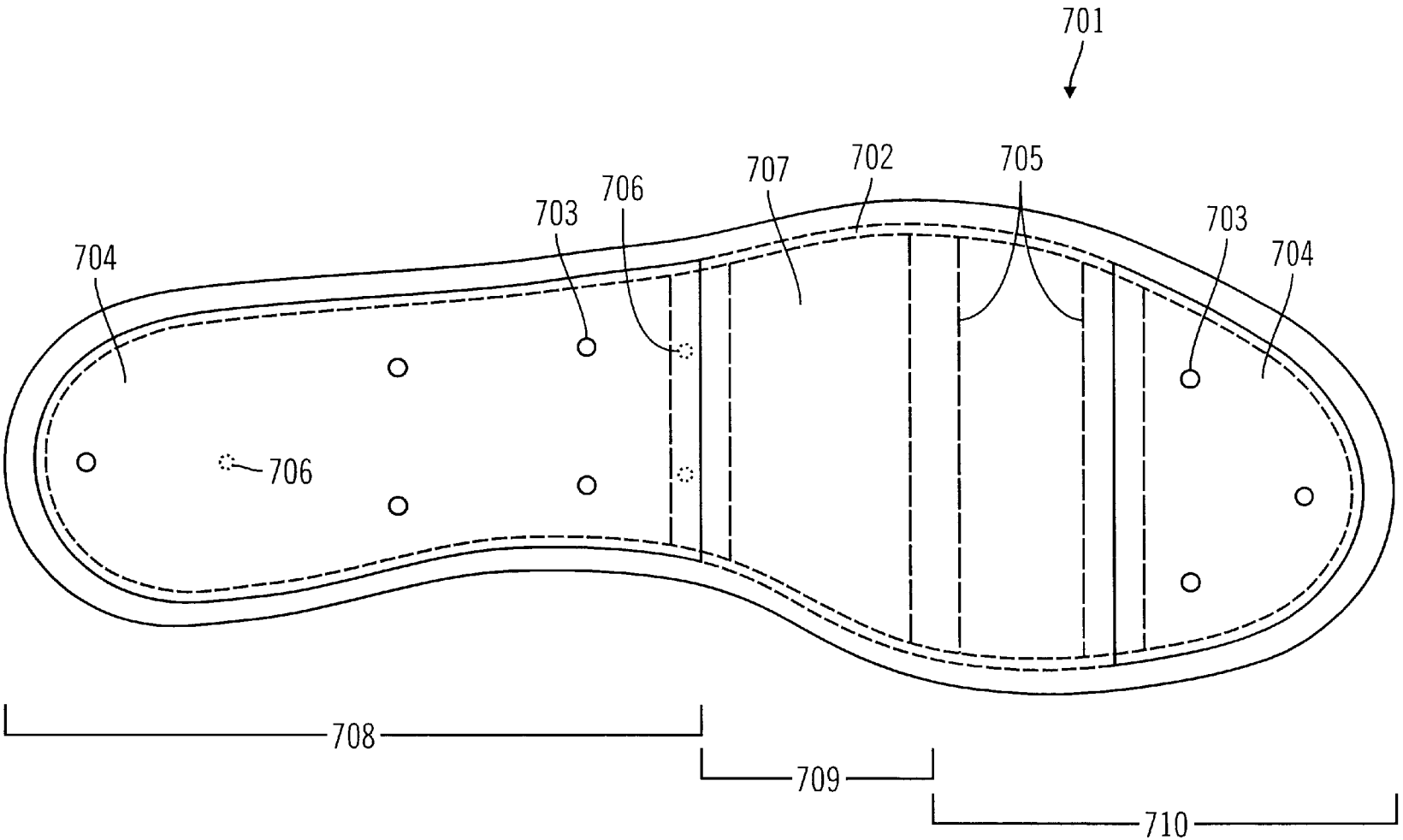

FIG. 7 is the top plan view of yet another insole according to the present invention.

DESCRIPTION OF PREFERRED EMBODIMENTS

The present invention relates to a sole design, with particular emphasis on the existence of openings in a footwear's insole and mid-sole, which are aimed to increasing the comfort, softness and flexibility of the software.

The present description is of the best presently contemplated mode of carrying out the invention. This description is made for the purpose of illustrating the general principles of the invention and should not be taken in a limiting sense. The scope of the invention is best determined by reference to the appended claims.

The present invention offers a way to improve the pliancy of the sole by placing holes in specific areas of certain layers of the shoe sole, especially the forefoot portion of the insole layer, as well as the entire midsole layer. In a preferred embodiment, the holes are placed at the forefoot portion of the insole layer near the area, against which the toes of the wearer usually bend, thus increasing the pliancy for that area and thereby increasing comfort for the wearer. Similarly, in a preferred embodiment, holes are placed over the entire midsole layer to the extent that it will not affect the supporting function of the midsole, while at the same time increasing the pliancy of the midsole.

Another unique aspect of the insole design is that the present invention limits the use of composite materials, such as cardboard with frame in the Texon board design described above, to form the structure of the insole, partly because once holes are placed on the Texon board, it will be difficult for the structure to return to its original state once bent. Further, not only will the board design decrease the comfort level for the wearer, it will also be easy for the board to rip at the area where holes are situated.

Figure 1:
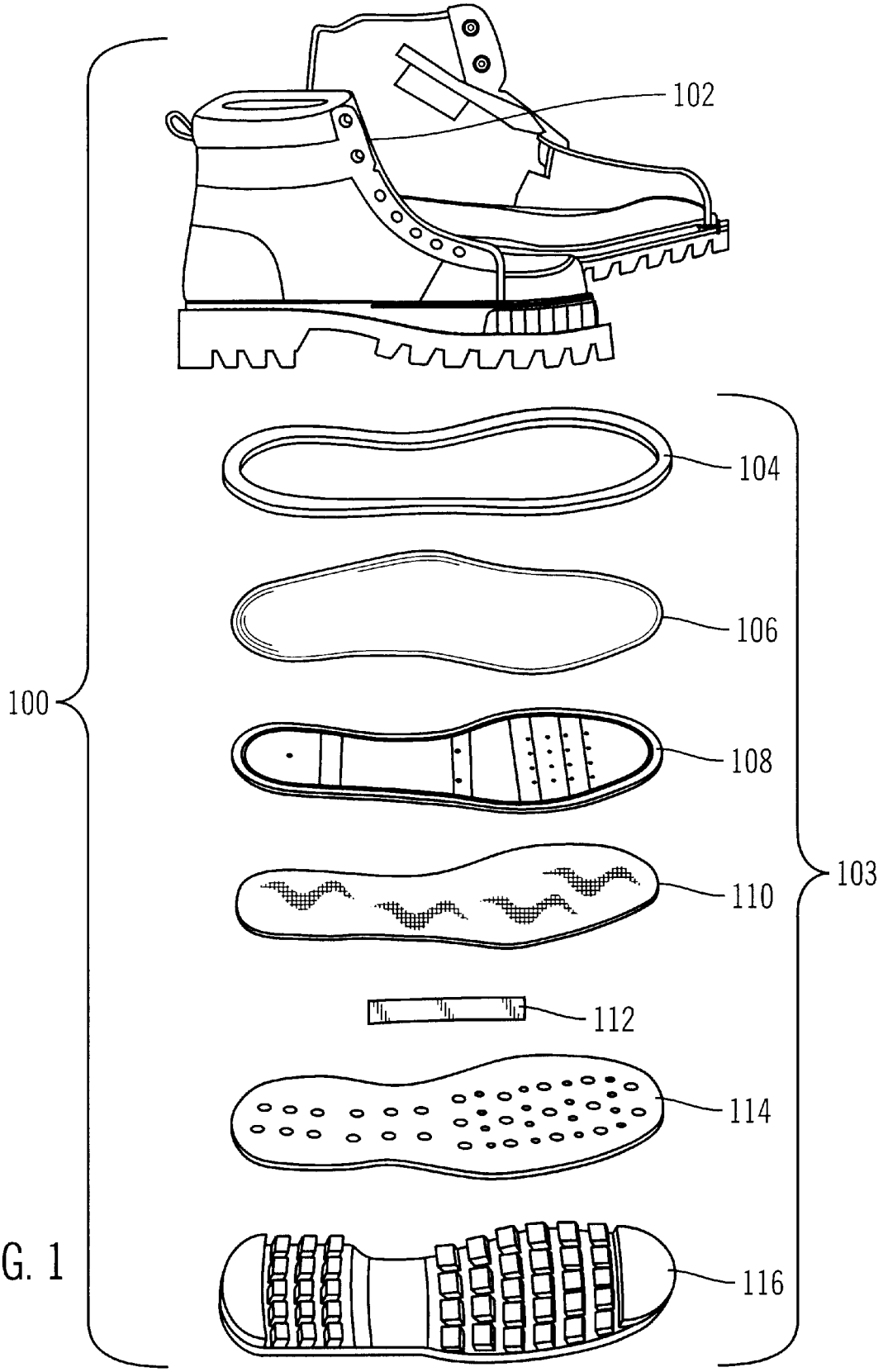
FIG. 1 is an exploded view of one embodiment of a footwear showing the assembly of the various components of the lower portion of the footwear that includes an insole in accordance with one embodiment of the present invention.

FIG. 1 illustrates the assembly of a footwear 100, and by way of illustration and not limitation, a work boot, which incorporates the insole in accordance with one embodiment of the present invention. It is noted that the illustration is of the left side of the footwear. The footwear 100 generally comprises a top portion 102 that is shaped to conform to the shape of the left foot of the wearer, and a bottom portion 103 for support of the weight of the wearer. The bottom portion 103 comprises various layers of materials and constructions (note, FIG. 1 shows the bottom view of each component), generally including a textile lining 106 that may be intended to absorb foot perspiration and provide cushioning for the wearer's comfort; an insole 108 of a construction in accordance with the present invention; a foam filler 110 that absorbs foot stress and tension; a steel shank 112 to provide additional rigidity in the longitudinal direction of the sole for industrial use, for example; a midsole 114 for providing support and reducing torque; and a rubber outsole 116 for traction and wear against a surface. The various layers of the bottom portion 103 may be assembled to the top portion 102 using a welt construction 104, such a the American Goodyear welt construction, which includes stitching using treated cotton twine.

Figure 2:
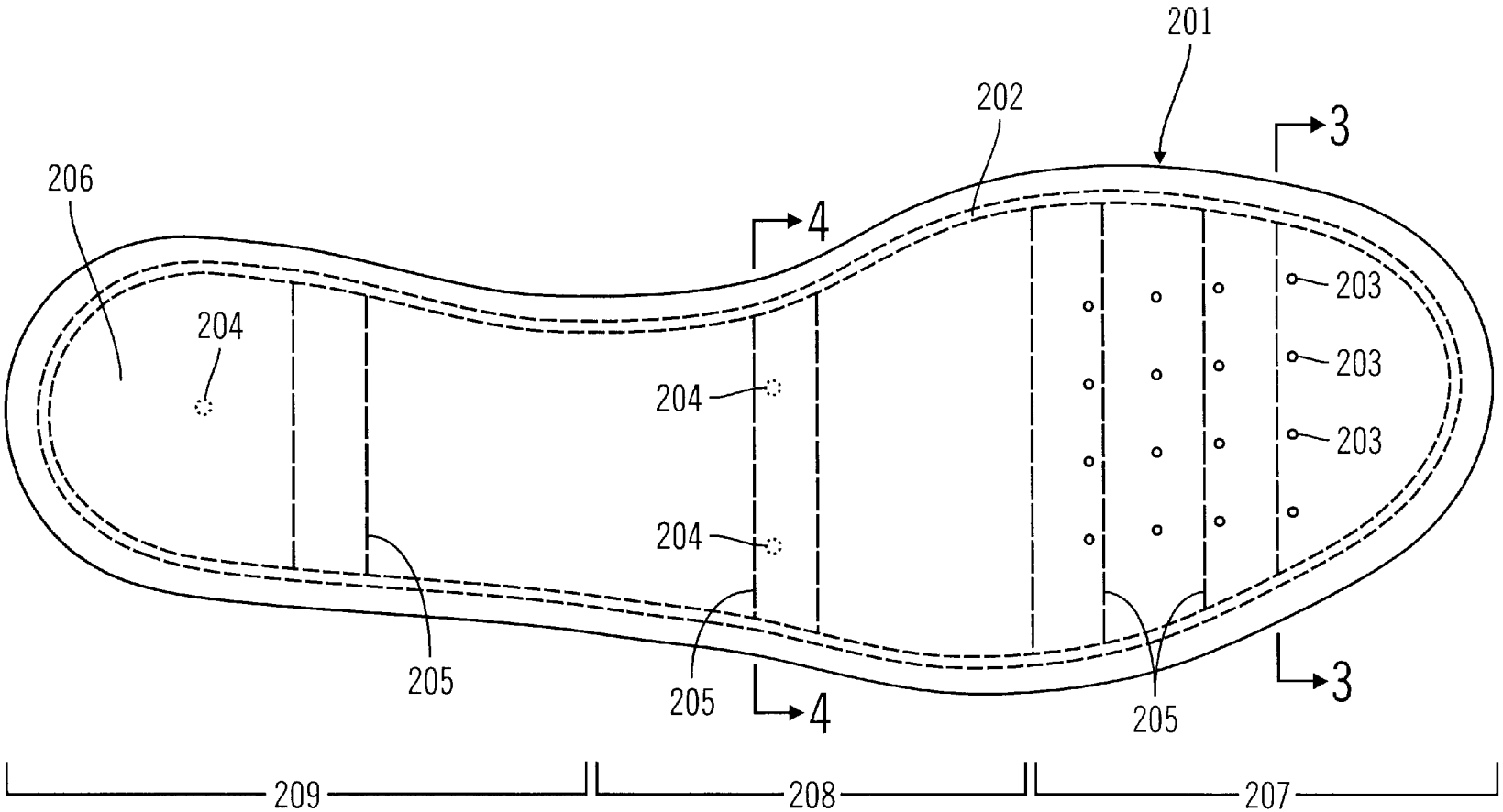
FIG. 2 is a top plan view of an insole construction embodying the present invention.
Figure 3:
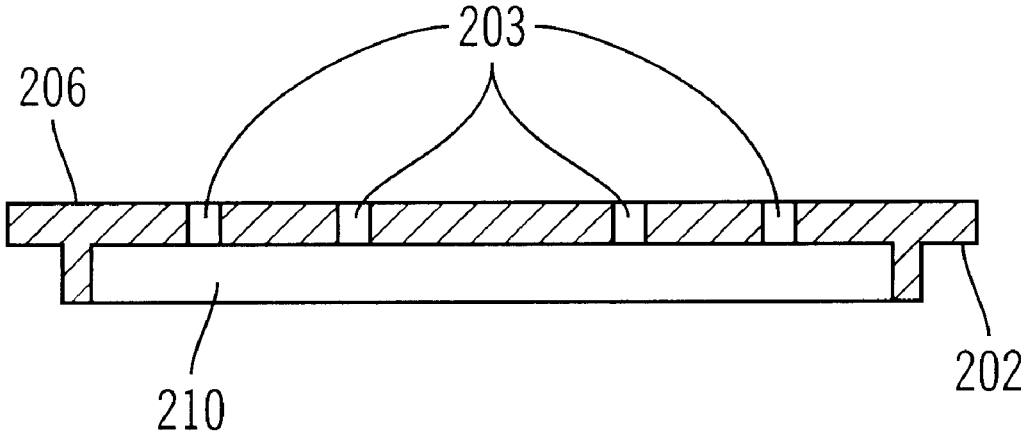
FIG. 3 is a cross-sectional view taken along lines 3—3 of FIG. 3.
Figure 4:
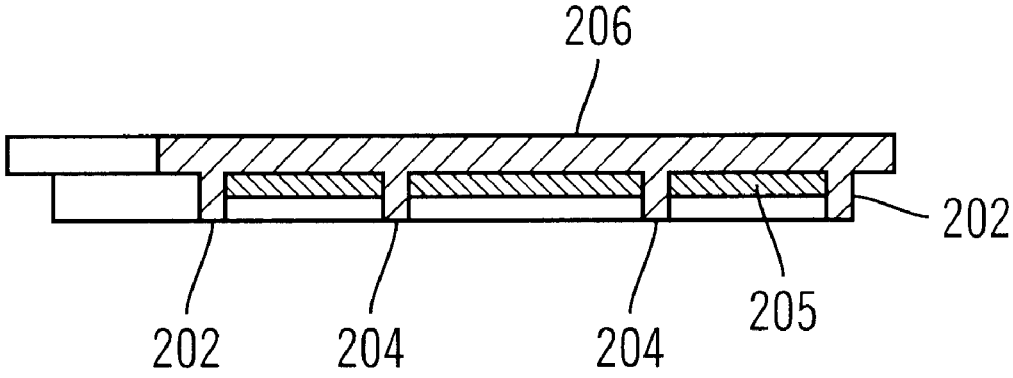
FIG. 4 is a cross-sectional view taken along lines 4—4 of FIG. 3.

Referring to the preferred embodiment of FIGS. 2–4, an insole construction 201 of the type to be fixedly secured to a footwear is illustrated. In these figures, the insole is taken from the right side of the footwear. The insole construction 201 comprises an insole layer of a unitary structure and made of a flexible material. One preferred material is the composition of the following: 61% of PVC resin, 36.5% of DOP, 1.1% of organic tin stabilizer, as well as optionally, some non-toxic calcium-zinc stabilizer and color material. It is found that the use of insole made of such material provides the desired combination of planar bending flexibility and lateral rigidity to the footwear.

The insole construction 201 has a top surface 206, a forefoot section 207, a mid section 208, and a heel section 209. The PVC-based material spans across the plane of the entire forefoot section 207. The forefoot section 207 supports the ball of a foot and the toes of the wearer. Several rows of holes 203 are provided across the forefoot section 207 to improve planar bending flexibility while maintaining lateral rigidity. As illustrated in the embodiment of FIG. 2, the rows of holes 203 are roughly parallel to each another. The flexibility of the insole depends in part on the size of the holes 203 and the relative spacing of between holes and between the rows. For example, for an adult size work boot, a diameter of 2 to 4 mm for the holes and an inter-hole spacing of 1 to 2 cm in a row and an inter-row spacing of about 1 to 2 cm would improve on the flexibility of the boot without compromising significantly the lateral rigidity of the boot.

On the bottom surface 210, and across the three sections, of the insole construction, ridges 205 are added to the insole to increase lateral resistance to external pressure, thereby providing enhanced structural support to the footwear. Further, spikes 204 are added to the bottom surface 210 of the insole to provide distance between the insole and a lower layer, for example, the midsole or the outsole of the footwear, so as to define a space to accommodate a soft filler 110 (see FIG. 1).

Along the perimeter of the insole construction 201, there is a flange 202, to which the insole 108 is stitched, stapled or otherwise fixedly secured to the other layers of the bottom section 103 (e.g., the midsole 114 or the outsole 116) and the top section 102 of the footwear 100. As shown in FIG. 1, a welt 104 may be provided for securely stitching the various components together using a treated cotton twine. As the flange 202 is anchored to the other layers of the bottom section by stitches, staples, or other fixating medium, it can be appreciated that the insole 108, together with other layers of the bottom section 103, essentially forms a spatial structure with the flange 202 acting like a wall for this spatial structure. Stitching the flange 202 with other layers via a welt reinforces laterally and torsionally this spatial structure. It can be appreciated that this spatial structure provides added lateral and torsional resistance and stability to the footwear as a whole.

Figure 5:
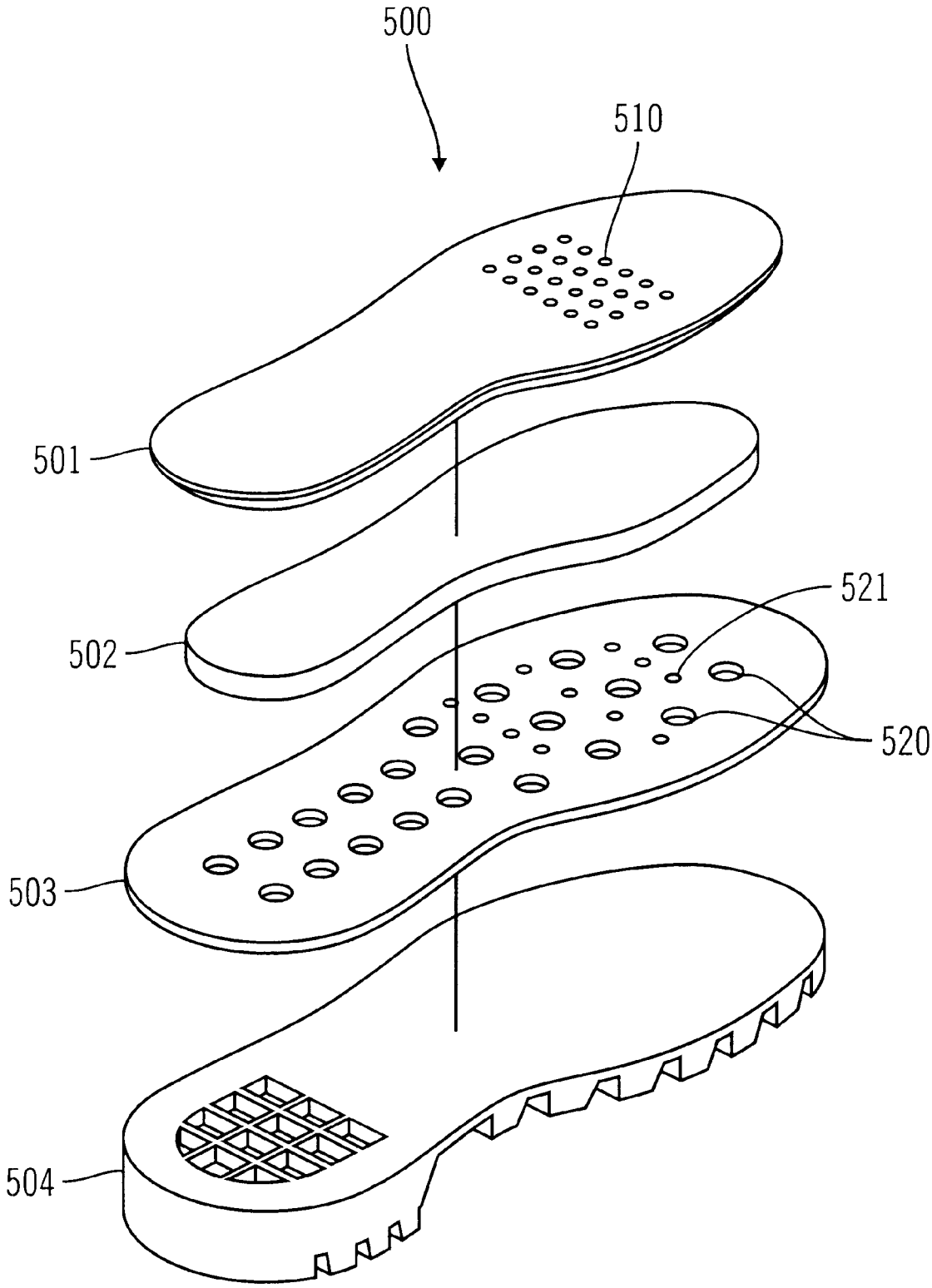
FIG. 5 is an exploded view of another embodiment of a footwear showing the assembly of the various components of the lower portion of the footwear that includes an insole and outsole in accordance with one embodiment of the present invention.

FIG. 5 illustrates a preferred embodiment of a lower portion of a footwear 500 incorporating this invention. From top to bottom, the lower portion 500 comprises an insole 501, a foam layer 502, a midsole 503 and an outsole 504. The structure and composition of the foam layer 502 and the outsole 504 are known in the prior art. Similar to the insole described in FIG. 2, in the forefoot portion of the insole 501, there are numerous holes 510. Also the insole 501 is made of a single material in a unitary structure. Further, there are holes 520 in the entire area of midsole 503. The number and distribution of the holes 520 are adjusted so that the midsole 503 will continue to provide support and yet display a desired level of flexibility. In a preferred embodiment, more holes 521 can be put next to or near holes 520 in the forefoot portion of the midsole 503 to complement the increased flexibility provided by the forefoot design of the insole 501.

FIGS. 6*a* and 6*b* illustrate the entire structure of the sole according to this invention and the condition when a wearer rests and walks with a footwear of such structure respectively. As shown in FIG. 6*b*, the holes 510 on the insole 501 are located at the forefoot portion when the end joints 601 of the wearer's toes 602 meet. Since when the wearer walks in a normal setting, he or she often uses the end-joints portion 601 as a leverage point to lift the heel 603 from the ground before next step can be made. At that time, the holes 510 on the insole 501 can adapt and bend according to the bending movement of the end-joints portion 601, facilitating a smooth progressing movement. At the same when the insole 501 adapts to the bending movement of the end-joints portion 601, the holes 530 and 531 in the midsole 503 will increase the pliancy of the sole design, achieving a smoother bending effect.

FIG. 7 represents yet another embodiment of the invention. To have a footwear with yet increased rigidity, the insole 701 is a composite of both a flexible member 707 and the Texon board 704 at strategic locations. As demonstrated in FIG. 7, the insole 701 has a forefoot section 710, a mid section 709, and a heel section 708. The flexible member 707 is made of similar materials that make insole 201 in FIG. 2. The Texon board 704 is essentially paper board. Openings 703 are added to the Texon board 704 to increase flexibility. In the preferred embodiment, Texon board 704 is attached to the flexible member 707 only in the toe portion of the forefoot section 710 and the heel section 708. The Texon board 704 at the toe portion extends to approximately the position where the toes of the wearer end. Similar to the insole 201, the insole 701 also has a flange 702, which allows the insole to be fixedly secured to the footwear, again preferably through a welt, such as those made of American Goodyear rubber. One common way of securing the insole to the footwear through the welt is to stitch the insole, the welt and the footwear together with a treated cotton twine. It can be appreciated that other ways of securing the insole with the footwear can be used. Further, like the insole 201, the insole 701 has ridges 705 and spikes 706, which again increase the lateral resistance and stability of the shoe and facilitate the assembly of the insole with the other layers of the shoe sole.

While the invention; has been described in detail with respect to the illustrated embodiments in accordance therewith, it will be apparent to those skilled in the art that various changes, modifications, substitutions, alterations and improvement may be made without departing from the scope and spirit of the invention as defined by the appended claims.

What is claimed is:

1. A footwear comprising:

a top portion;

a bottom portion, wherein the bottom portion includes:

a unitary insole made of a flexible material;

said insole being fixedly secured to said footwear by stitching along the perimeter of said insole;

said insole comprising a forefoot section, a mid section, and a heel section;

a plurality of openings specifically located on said insole to facilitate bending of said footwear; and a ridge located at at least one of forefoot section, mid section or heel section of said insole, said ridge located on the surface underneath said insole, said ridge extending sideways from one edge to the other edge of said insole.

2. A footwear as claimed in claim 1, wherein said plurality of openings are located at the forefoot section of said insole.

3. A footwear as claimed in claim 1, wherein said insole is fixedly secured to the footwear by stitching said insole with other layers in said footwear via a welt.

4. A footwear as claimed in claim 1, wherein said bottom portion further comprises a midsole and a plurality of openings specifically located on said midsole to facilitate bending of said footwear.

5. A footwear comprising:

a top portion;

a bottom portion, wherein the bottom portion includes:

an insole that comprises a unitary frame made of a flexible material;

said insole being fixedly secured to said footwear by stitching along the perimeter of said insole;

said insole comprising a forefoot section, a mid section, and a heel section a plurality of openings specifically located on said insole to facilitate bending of said footwear; and a ridge located at at least one of forefoot section, mid section or heel section of said insole, said ridge located!on the surface underneath said insole, said ridge extending sideways from one edge to the other edge of said insole.

6. A footwear as claimed in claim 5, wherein the entire insole is a unitary structure made of a flexible material.

7. A footwear as claimed in claim 5, wherein said insole further comprises a section made of a flexible material unitary to said unitary frame, and a layer of a different, relatively harder material.

8. A footwear as claimed in claim 7, wherein a plurality of openings are provided on said layer of relatively hard material.

* * * * *